US012680763B2

(12) United States Patent
Liu

(10) Patent No.: US 12,680,763 B2
(45) Date of Patent: Jul. 14, 2026

(54) HEAT PIPE STRUCTURE

(71) Applicant: ASIA VITAL COMPONENTS CO., LTD., New Taipei City (TW)

(72) Inventor: Han-Min Liu, New Taipei City (TW)

(73) Assignee: ASIA VITAL COMPONENTS CO., LTD., New Taipei City (TW)

( * ) Notice: Subject to any disclaimer, the term of this patent is extended or adjusted under 35 U.S.C. 154(b) by 82 days.

(21) Appl. No.: 17/385,911

(22) Filed: Jul. 27, 2021

(65) Prior Publication Data

US 2023/0030019 A1 Feb. 2, 2023

(51) Int. Cl.
*F28D 15/04* (2006.01)

(52) U.S. Cl.
CPC ..... *F28D 15/046* (2013.01)

(58) Field of Classification Search
CPC ... F28D 15/046; F28D 15/04; H05K 7/20336; H05K 7/2029; H01L 23/427
See application file for complete search history.

(56) References Cited

U.S. PATENT DOCUMENTS 8,720,062 B2 * 5/2014 He ..... H01L 21/4871 29/890.032
2002/0179288 A1 * 12/2002 Ishida ..... F28D 15/046 165/104.21
2005/0269064 A1 * 12/2005 Hsu ..... F28D 15/0233 165/104.26
2006/0157229 A1 * 7/2006 Hong ..... F28D 15/046 165/104.26
2007/0234566 A1 * 10/2007 Hsu ..... F28D 15/046 29/890.032
2008/0099186 A1 * 5/2008 Yu ..... F28D 15/046 165/104.11
2011/0232877 A1 * 9/2011 Meyer, IV ..... F28D 15/046 165/104.33

(Continued)

FOREIGN PATENT DOCUMENTS

CN 202562344 U 11/2012
CN 202836291 U 3/2013

(Continued)

OTHER PUBLICATIONS

Search Report dated Sep. 1, 2022 issued by Taiwan Intellectual Property Office for counterpart application No. 110122994.

(Continued)

*Primary Examiner* — Tho V Duong
(74) *Attorney, Agent, or Firm* — Demian K. Jackson; Jackson IPG PLLC

(57) ABSTRACT

A heat pipe structure includes a main body. The main body has an internal airtight chamber. At least one capillary structure is disposed on a wall face of the airtight chamber. A working fluid is filled in the airtight chamber. The main body has at least one stress concentration section. A retaining reinforcement member is disposed on the capillary structure corresponding to the stress concentration section for reinforcing the capillary structure and securely retaining the capillary structure on the wall face. When the heat pipe is flexed, bent and deformed, the retaining reinforcement member serves to prevent the capillary structure disposed on the stress concentration section from cracking or damaging.

6 Claims, 2 Drawing Sheets

(56) References Cited

U.S. PATENT DOCUMENTS

2012/0048516 A1* 3/2012 He ..... F28D 15/0233 165/104.26
2012/0048518 A1* 3/2012 Zhou ..... F28D 15/046 165/104.26
2012/0216991 A1* 8/2012 Chen ..... H01L 21/4882 29/890.032
2012/0305223 A1* 12/2012 Yang ..... F28D 15/046 29/890.032
2012/0325438 A1* 12/2012 Meyer, IV ..... F28D 15/046 165/104.26
2016/0131440 A1* 5/2016 Lee ..... F28D 15/0233 165/185
2016/0154441 A1* 6/2016 Shen ..... G06F 1/163 361/679.03
2016/0201994 A1* 7/2016 Shen ..... F28F 13/182 165/185
2020/0326134 A1* 10/2020 Chen ..... H01L 23/427
2021/0071963 A1* 3/2021 Hulse ..... F28D 15/046

FOREIGN PATENT DOCUMENTS

| | | | |
|---|---|---|---|
| CN | 215638974 | U | 1/2022 |
| TW | M309661 | U | 4/2007 |
| TW | M432817 | U | 7/2012 |
| TW | 201331533 | A | 8/2013 |
| TW | M617116 | U | 9/2021 |

OTHER PUBLICATIONS

Search Report dated May 26, 2022 issued by Taiwan Intellectual Property Office for counterpart application No. 110122994.
Search Report dated Jan. 11, 2023 issued by China National Intellectual Property Administration for counterpart application No. 2021106991402.

* cited by examiner

HEAT PIPE STRUCTURE

BACKGROUND OF THE INVENTION

1. Field of the Invention

The present invention relates generally to a heat pipe structure, and more particularly to a heat pipe structure having a retaining reinforcement member. When the heat pipe is flexed, bent and deformed, the retaining reinforcement member serves to prevent the internal capillary structure from cracking or damaging.

2. Description of the Related Art

Heat pipe is an often seen heat transfer component. A heat pipe is often applied to a part in an electronic device or handheld device, which necessitates face-to-face heat conduction. The heat pipe has an internal airtight chamber and a working liquid is filled in the airtight chamber. The working liquid serves to perform heat conduction by means of two-phase fluid. The heat pipe can quickly conduct heat from a point to another point. The heat pipe has the advantage of quick transfer of the heat generated by a heat source to a remote end for other heat dissipation components to conduct and dissipate the heat. Accordingly, the heat is prevented from accumulating in the heat source.

Along with the trend to miniature and thin the electronic device, the internal space of the electronic device for arrangement of the electronic components and the heat pipe is minified. Therefore, it is necessary to shape, (that is, flex, bend and deform) the heat pipe in adaptation to the remaining limited space so as to dispose the heat pipe in the space in attachment to the heat source for conducting the heat.

When manufacturing the heat pipe, a hollow tube is first provided. Then a central bar with a diameter smaller than the inner diameter of the hollow tube is placed into the hollow tube. Metal powders are then filled into the space between the central bar and the hollow tube. The metal powders are compacted and then sintered. Then water is filled into the hollow tube. Thereafter, the hollow tube is vacuumed and sealed. Alternatively, some manufacturers form axial channels on the wall face of the hollow tube or dispose curled mesh body in the hollow tube as capillary structure. The above three capillary structures are all often seen capillary structures disposed in the heat pipe. After the capillary structure is disposed in the hollow tube, the heat pipe is finally pressed and flattened into a flat heat pipe for arranging the heat pipe is a narrow space.

When the formed heat pipe is flexed, bent and deformed, the internal capillary structure is subject to damage. For example, the sintered powder body on the flexed and bent portion is apt to crack and detach from the wall face. Also, when the heat pipe is pressed and flattened, the channels will be compressed and over-deformed to lose their original width. On the other hand, when the heat pipe is over-extended, the channels will be expanded to enlarge the original width of the channels. Also, the mesh body is apt to detach from the wall face. All the above situations will make the heat pipe lose its capillary attraction.

It is therefore tried by the applicant to provide a heat pipe structure, which has a retaining reinforcement member. When the heat pipe is pressed and flattened or shaped, the retaining reinforcement member serves to prevent the internal capillary structure from damaging.

SUMMARY OF THE INVENTION

It is therefore a primary object of the present invention to provide a heat pipe structure, which can improve the shortcoming of the conventional heat pipe structure that after the heat pipe is flexed, bent and deformed, the internal capillary structure is apt to damage and fail.

To achieve the above and other objects, the heat pipe structure of the present invention includes a main body. The main body has an internal airtight chamber. At least one capillary structure is disposed on a wall face of the airtight chamber. A working fluid is filled in the airtight chamber. The main body has at least one stress concentration section. A retaining reinforcement member is disposed on the capillary structure corresponding to the stress concentration section.

By means of the heat pipe structure of the present invention, after the heat pipe is completely manufactured and the heat pipe is flexed, bent and deformed, the internal capillary structure is prevented from being damaged.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
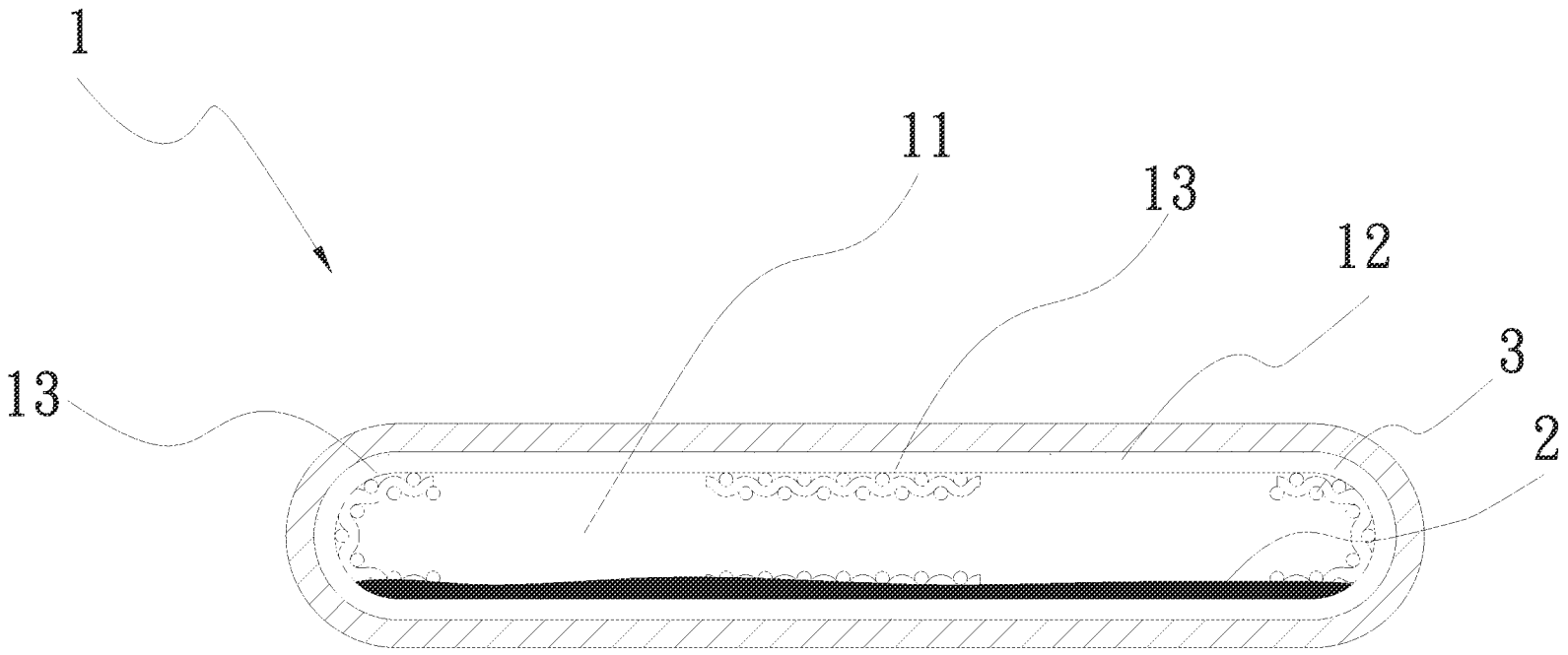
FIG. 1 is a sectional view of a first embodiment of the heat pipe structure of the present invention.

Please refer to FIG. 1, which is a sectional view of a first embodiment of the heat pipe structure of the present invention. As shown in the drawing, the heat pipe structure of the present invention includes a main body 1.

The main body 1 can be a one-piece main body or composed of an upper plate body and a lower plate body correspondingly mated with each other. The main body 1 has an internal airtight chamber 11. At least one capillary structure 12 is disposed on a wall face of the airtight chamber 11. A working fluid 2 is filled in the airtight chamber 11. The main body 1 has at least one stress concentration section 13. A retaining reinforcement member 3 is disposed the capillary structure 12 corresponding to the stress concentration section 13.

The stress concentration section 13 of the main body 1 is mainly formed for the reason that after an external force is applied to the main body 1, the main body 1 is flexed, bent and deformed in adaptation to the arrangement space or position. For example, in the case the main body 1 is pressed and flattened from a circular configuration into a flat configuration, the stress concentration section 13 is positioned at the round angle portion of the junction between the flat face and the arc face of the main body 1 or the over-extended plane face of the main body 1 or the bent portion of the main body 1. The capillary structure 12 correspondingly disposed on the stress concentration section 13 will be damaged due to stress concentration.

The main body 1, the capillary structure 12 and the retaining reinforcement member 3 are made of a material selected from a group consisting of copper, aluminum, stainless steel, titanium, titanium alloy, aluminum alloy and plastic material. The main body 1, the capillary structure 12 and the retaining reinforcement member 3 can be made of the same material or different materials. The working fluid 2 is selected from a group consisting of coolant, acetone, pure water and alcohol.

In this embodiment, the capillary structure 12 is selected from a group consisting of sintered powder body, channels, mesh body and fiber body. In this embodiment, the capillary structure 12 is, but not limited to, sintered powder body for illustration purposes. The retaining reinforcement member 3 is coated on the surface of the capillary structure 12 (sintered powder body) of the stress concentration section 13 of the main body 1 or embedded in the capillary structure 12. When the main body 1 is pressurized by the external force and deformed (flexed and bent), the retaining reinforcement member 3 can fully hold and retain the surface of the capillary structure 12 disposed on the stress concentration section 13. Accordingly, the capillary structure 12 (sintered powder body) is prevented from cracking and detaching from the wall face of the airtight chamber 11. In this case, the capillary structure 12 in the airtight chamber 11 can keep complete to fully maintain the two-phase fluid working in the heat pipe structure.

Figure 2:
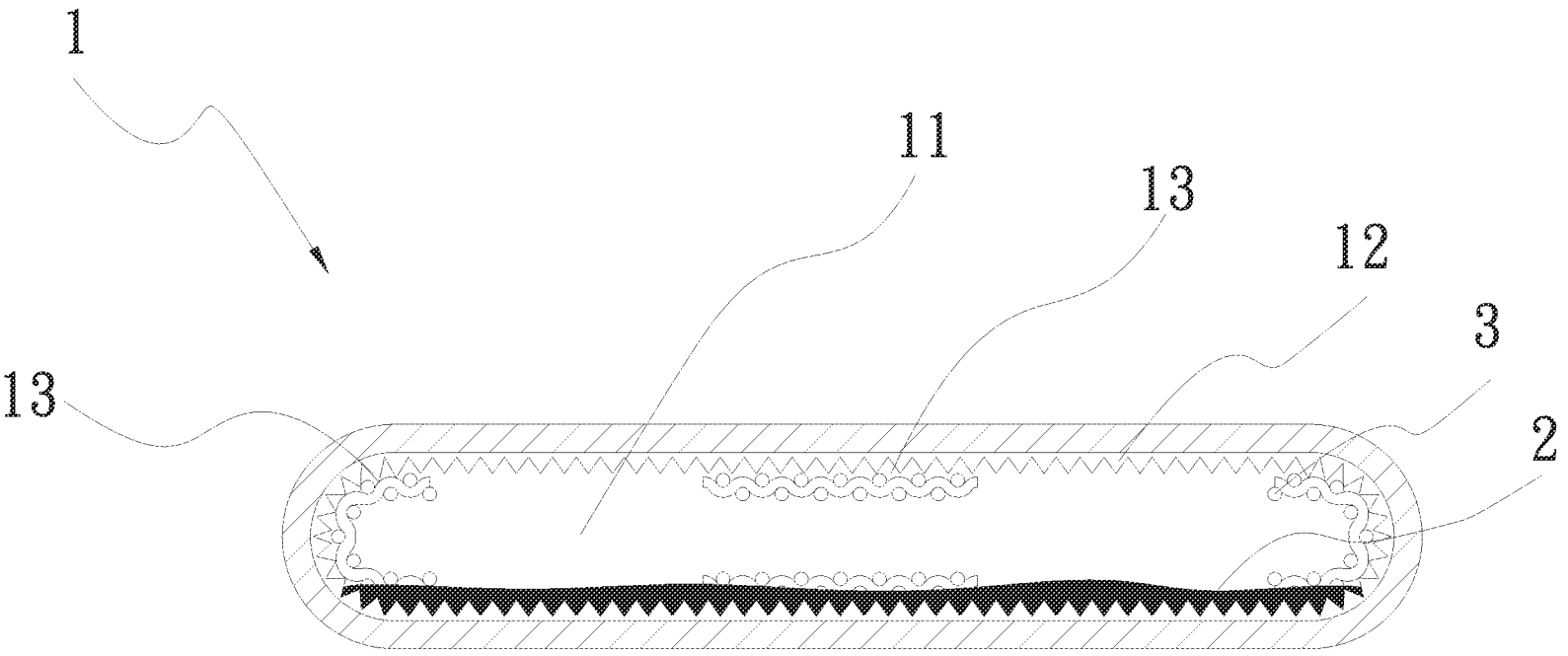
FIG. 2 is a sectional view of a second embodiment of the heat pipe structure of the present invention.

Please refer to FIG. 2, which is a sectional view of a second embodiment of the heat pipe structure of the present invention. The second embodiment is partially identical to the first embodiment in structure and thus will not be redundantly described hereinafter. The second embodiment is different from the first embodiment in that the capillary structure 12 is multiple channels. The retaining reinforcement member 3 is coated and connected on the surface of the capillary structure 12 disposed on the stress concentration section 13 of the airtight chamber 11. The retaining reinforcement member 3 also serves to limit the width of the channels, whereby when the external force is applied to the main body 1 and the main body 1 is plastically deformed, the capillary structure 12 (channels) in the airtight chamber 11 is prevented from being over-deformed (compressed and minified or over-expanded). Accordingly, the capillary structure 12 can keep the capillary attraction.

In the second embodiment, the capillary structure 12 is multiple channels. The retaining reinforcement member 3 is coated and connected on the surface of the airtight chamber 11 corresponding to the stress concentration section 13. The retaining reinforcement member 3 serves to limit the width of the channels so as to prevent the channels from being over-deformed.

In the above first and second embodiments, the capillary structure 12 is connected with the retaining reinforcement member 3 by means of plainly attaching the retaining reinforcement member 3 onto the surface of the capillary structure 12. Alternatively, the retaining reinforcement member 3 can be disposed inside the single-layer capillary structure 12 as a skeleton, whereby the capillary structure 12 encloses the retaining reinforcement member 3. Still alternatively, multiple layers of capillary structures 12 are selectively employed and the retaining reinforcement member 3 is interposed between the capillary structures 12 as an integral body. Still alternatively, various capillary structures 12 are laminated and the retaining reinforcement member 3 is sandwiched between the capillary structures 12 and connected therewith as an integral body. Still alternatively, the retaining reinforcement member 3 is first disposed on the surface of the airtight chamber 11 of the main body 1 and then the capillary structure 12 is disposed thereon. According to the above arrangement, the retaining reinforcement member 3 provides higher strength and support for the capillary structure 12 to more securely and tightly retain the capillary structure 12 on the wall face of the airtight chamber 11. Therefore, when the main body 1 is bent or twisted to lead to concentration of stress, the capillary structure 12 is prevented from damaging and cracking to cause deterioration of the capillary efficiency or failure of the capillary structure 12.

In the present invention, when the main body 1 is flexed, bent and deformed, a stress concentration section is apt to be formed on the flexed, bent and deformed portion of the main body. The retaining reinforcement member 3 is disposed on the capillary structure 12 correspondingly disposed on the stress concentration section 13 to reinforce the internal capillary structure 12. The stress concentration section of the main body 1 is often formed on the bent portion, over-extended or over-stretched portion of the main body 1 or the turning corner portion of the main body 1 after compressed. With respect to the main body 1 itself, the stress concentration can be eliminated by means of guide angle or guide round angle. However, the capillary structure 12 inside the main body 1 cannot be processed by this means. Therefore, the retaining reinforcement member 3 is connected with the capillary structure 12 on the stress concentration section 13 to enhance the strength of the capillary structure 12 so as to improve the shortcoming of the conventional heat pipe structure.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A heat pipe structure comprising:

a main body having an internal airtight chamber and stress concentration sections arranged on bent portions and on over-extended portions of the main body, at least one layered capillary structure disposed on a wall face of the airtight chamber, a working fluid filled in the airtight chamber, and separate retaining reinforcements, each configured as a skeletal structure arranged on an interior surface of the capillary structure and corresponding to a corresponding one of the stress concentration sections to inhibit the capillary structure from cracking or damage.

2. The heat pipe structure as claimed in claim 1, wherein the stress concentration sections are positioned on one of the portions of a deformed portion of the main body or a reworked portion of the main body after forming and a flexed, bent, and deformed portion of the main body.

3. The heat pipe structure as claimed in claim 1, wherein the main body, the capillary structure, and the retaining reinforcements are made of a material selected from a group consisting of copper, aluminum, stainless steel, titanium, titanium alloy, and aluminum alloy, the main body, the capillary structure, and the retaining reinforcements being made of the same material or different materials.

4. The heat pipe structure as claimed in claim 1, wherein the working fluid is selected from a group consisting of coolant, acetone, pure water and alcohol.

5. The heat pipe structure of claim 1, wherein the airtight chamber defines an open space for the working fluid as two phases.

6. The heat pipe structure of claim 1, wherein the least one layered capillary structure has multiple channels and wherein the retaining reinforcements limit widths of the multiple channels.

* * * * *